US010150148B2

(12) United States Patent
Menosso et al.

(10) Patent No.: US 10,150,148 B2
(45) Date of Patent: Dec. 11, 2018

(54) BAR UNLOADING APPARATUS OF THE REVOLVER TYPE PROVIDED WITH BRAKING DEVICE

(71) Applicant: Danieli & C. Officine Meccaniche S.P.A., Buttrio (IT)

(72) Inventors: Fausto Menosso, Pradamano (IT); Flavio Della Rossa, Buttrio (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 365 days.

(21) Appl. No.: 15/109,516

(22) PCT Filed: Dec. 30, 2014

(86) PCT No.: PCT/IB2014/067406
§ 371 (c)(1),
(2) Date: Jul. 1, 2016

(87) PCT Pub. No.: WO2015/101926
PCT Pub. Date: Jul. 9, 2015

(65) Prior Publication Data

US 2016/0325326 A1 Nov. 10, 2016

(30) Foreign Application Priority Data

Jan. 2, 2014 (IT) ..... MI2014A0003

(51) Int. Cl.
*B21B 39/08* (2006.01)
*B21D 43/00* (2006.01)
*B21B 43/00* (2006.01)

(52) U.S. Cl.
CPC ..... *B21B 39/086* (2013.01); *B21B 43/003* (2013.01); *B21D 43/006* (2013.01)

(58) Field of Classification Search
CPC ..... B21B 15/0007; B21B 2015/0014; B21B 39/086; B21B 43/003; B21D 43/006;
(Continued)

(56) References Cited

U.S. PATENT DOCUMENTS

2005/0103578 A1* 5/2005 Weiss ..... F15B 15/262 188/67
2011/0017577 A1* 1/2011 Shore ..... B21B 43/003 198/786

FOREIGN PATENT DOCUMENTS

| | | |
|---|---|---|
| EP | 0411688 | 2/1991 |
| EP | 1579932 | 9/2005 |
| WO | WO2006092404 | 9/2006 |

* cited by examiner

*Primary Examiner* — Saul Rodriguez
*Assistant Examiner* — Brendan P Tighe
(74) *Attorney, Agent, or Firm* — Stetina Brunda Garred & Brucker

(57) ABSTRACT

A bar unloading apparatus of the revolver type, comprising: —a longitudinal rotor (10) divided into at least three longitudinal stretches (11, 12, 13) integral with one another and adapted to rotate about a longitudinal rotation axis, on the outer longitudinal surfaces of which there is provided a plurality of longitudinal channels, extending on the at least three stretches over the whole longitudinal extension of the rotor (10) and parallel to said longitudinal axis, to receive respective longitudinal bars, —and at least one braking device for braking the longitudinal bars entering in at least one of the longitudinal channels, wherein the at least one braking device is integrated in at least one first stretch (12) of said at least three longitudinal stretches (11, 12, 13), is rotationally fixed to the longitudinal rotor (10) and is provided with braking elements (1) in each of said longitudinal channels so that said at least one braking device can rotate together with the longitudinal rotor (10) and brake the
(Continued)

longitudinal bars even during a rotation of the longitudinal rotor (10).

12 Claims, 7 Drawing Sheets

(58) Field of Classification Search
CPC ..... B21D 43/285; Y10T 29/49989; Y10T 29/5116; Y10T 29/5129
USPC ..... 29/527.6, 34 R; 72/203, 204, 250, 294, 72/426; 188/67; 198/598; 227/76
See application file for complete search history.

BAR UNLOADING APPARATUS OF THE REVOLVER TYPE PROVIDED WITH BRAKING DEVICE

CROSS REFERENCE TO RELATED APPLICATIONS

The present application claims priority to PCT International Application No. PCT/IB2014/067406 filed on Dec. 30, 2014, which application claims priority to Italian Patent Application No. MI2014A000003 filed Jan. 2, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to an unloading apparatus of the revolver type in which the bars are braked before being unloaded.

BACKGROUND ART

In a longitudinal bar unloading apparatus, the bars arrive at a given speed in the longitudinal direction and must be braked to unload them transversely either rightwards or leftwards.

The unloading apparatuses of the revolver type are characterized by a plurality of channels or grooves or niches made on a rotor, in which the bars enter and are braked to then be rotated together with the movement of the entire rotor.

In the prior art, the bars are braked by means of fixed devices, which do not rotate together with the rotor, placed at the bar inlet zone into one of the rotor channels. It is thus necessary to wait for the bar to be braked and for the brake to then be disengaged so as to not hinder the rotor rotation before rotating the rotor and allowing a free channel of the rotor reach said bar inlet zone. Therefore, these systems are only suitable for rather low material arrival speeds: the need to have an immediately free channel for the introduction of the material becomes more and more important as the speed increases.

SUMMARY OF THE INVENTION

It is the main object of the present invention to provide an apparatus for unloading longitudinal bars, for example from a production plant of drawn, peeled, ground or rolled bars, said apparatus being provided with at least one bar braking device which permits to rotate the rotor as soon as the tail of the bar is introduced in the respective channel, even if the bar has not yet been completely braked.

It is another object of the present invention to provide a longitudinal bar unloading apparatus provided with a bar braking device which permits to support high bar arrival speeds.

It is a further object of the present invention to provide a longitudinal bar unloading device which permits to speed up the production cycle significantly.

The present invention thus aims at achieving the above-mentioned objects by making a longitudinal bar unloading apparatus which, according to claim 1, comprises a longitudinal rotor divided into at least three longitudinal stretches integral with one another and adapted to rotate about a longitudinal rotation axis, on the outer surfaces of which there is provided a plurality of longitudinal channels, extending on the at least three stretches over the whole longitudinal extension of the rotor and parallel to said longitudinal axis, to receive respective longitudinal bars; and comprises at least one braking device for braking the longitudinal bars entering in at least one of the longitudinal channels; wherein the at least one braking device is integrated in at least one first stretch of said at least three longitudinal stretches, is rotationally fixed to the longitudinal rotor and is provided with braking elements in each of said longitudinal channels, so that said at least one braking device can rotate together with the longitudinal rotor and brake the longitudinal bars even during a rotation of the longitudinal rotor.

According to a second aspect of the present invention, a bar braking method is provided, by means of the aforesaid unloading apparatus, which, according to claim 12, comprises the following steps:

- providing the braking elements in an opening position in at least one first channel of said longitudinal channels to leave the space inside the first channel free;
- inserting a longitudinal bar into said first channel;
- once the tail of said longitudinal bar is inside said first channel, rotating the longitudinal rotor by a predetermined angular amplitude about the longitudinal axis, while simultaneously braking the longitudinal bar by switching the braking elements from said opening position to a closing position on said longitudinal bar.

The present invention thus provides a bar unloading apparatus provided with a least one bar braking device which, by being fixed to the revolver or rotor, can rotate together with the rotor itself, thus being able to brake the bar during the rotation.

Such a braking device is provided with a pair of braking elements for each longitudinal channel of the rotor. Such braking elements with a symmetric movement can approach each other thus closing the bar present in the channel and consequently braking it. The actuating means of the braking elements comprise at least one fixed cylinder, either hydraulic or pneumatic, which does not translate with respect to the rotor and does not rotate together with the rotor.

When the bar enters into the respective channel, the braking elements must be opened to allow it to pass, without obstructing the travel of the bar. In case of particularly high arrival speeds of the bars, it is thus appropriate to release the pairs of braking elements in the different channels.

Due to the braking device of the unloading apparatus, which is the subject of the invention, the production cycle can be speeded up because the rotor can rotate as soon as the tail of the bar also enters into the respective channel, without needing to wait for the bar to be braked and for the brake to reopen so as to not hinder the rotation as occurs in the prior art. The dependent claims describe preferred embodiments of the invention.

BRIEF DESCRIPTION OF THE DRAWINGS

Further features and advantages of the present invention will become apparent in the light of the detailed description of a preferred, but not exclusive, embodiment of a bar unloading apparatus, shown by way of non-limitative example, with the aid of the accompanying drawings, in which.

The same reference numerals in the figures identify the same elements or components.

DETAILED DESCRIPTION OF PREFERRED EMBODIMENTS OF THE INVENTION

The figures show a first embodiment of an unloading apparatus adapted to receive bars at high forward speed, which bars are from an upstream plant, to brake said bars and finally unload said bars transversely from either one or the other side with respect to a vertical plane containing a longitudinal axis X defined by the apparatus itself.

The apparatus, which is the subject of the present invention, comprises:

- a longitudinal rotor 10 divided into at least three longitudinal stretches 11, 12, 13 integral with one another and adapted to rotate about the longitudinal rotation axis X, on the outer surfaces of which there is provided a plurality of longitudinal channels A, B, C, D, extending on the three stretches 11, 12, 13 over the whole longitudinal extension of rotor 10 and parallel to the longitudinal axis X, to receive respective longitudinal bars,
- and at least one braking device 20 for braking the longitudinal bars entering in at least one of the longitudinal channels A, B, C, D.

The braking device 20 is advantageously integrated in at least one first stretch 12 of rotor 10 and is rotationally fixed to the rotor itself so that said the braking device 20 can rotate together with rotor 10 and brake the longitudinal bars even during a rotation of the rotor. More than one braking device 20 can be provided, each braking device being integrated in a respective longitudinal stretch of the rotor and rotationally fixed to the rotor itself.

Figure 1:
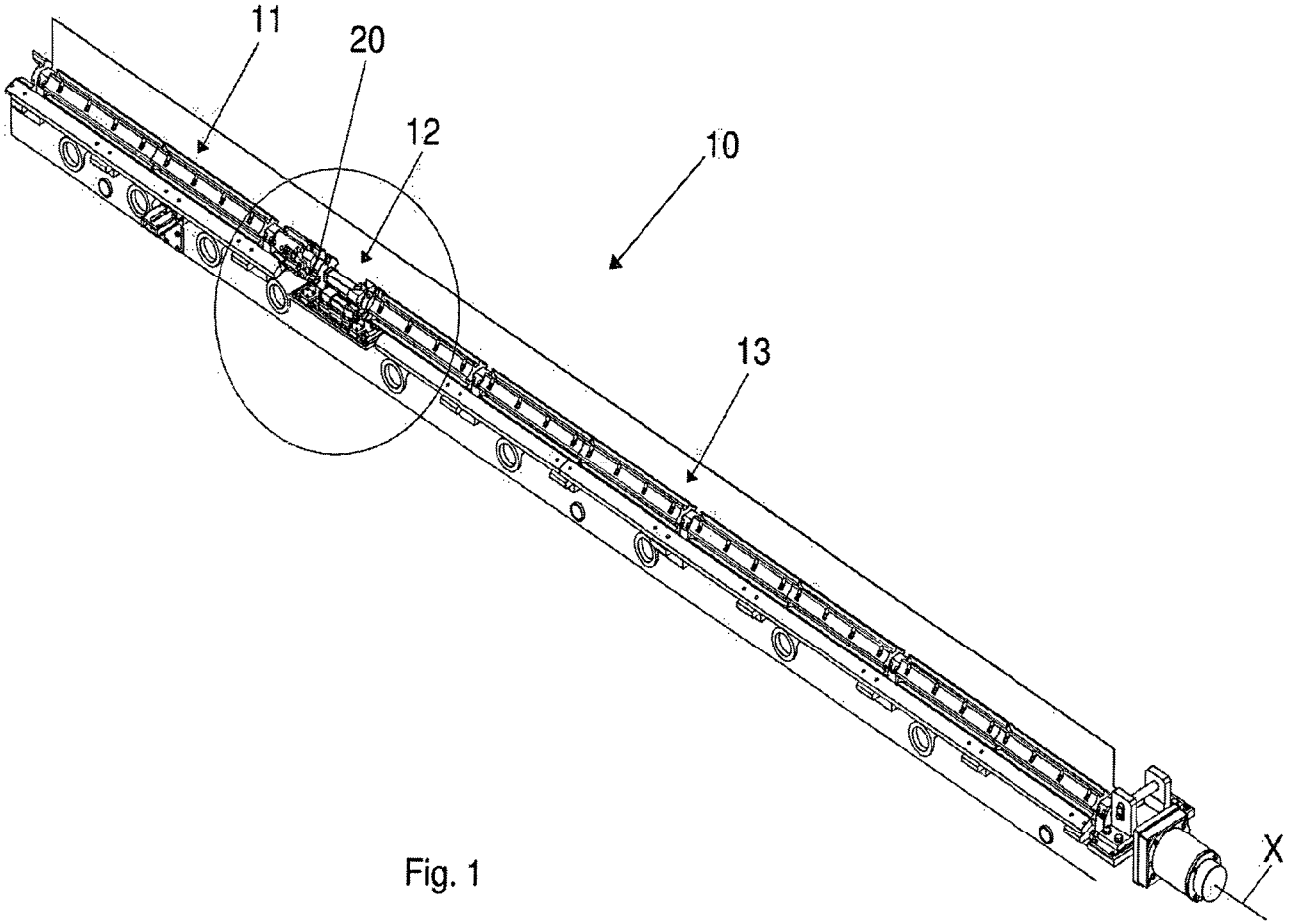
FIG. 1 is a perspective view of an unloading apparatus according to the invention.
Figure 1A:
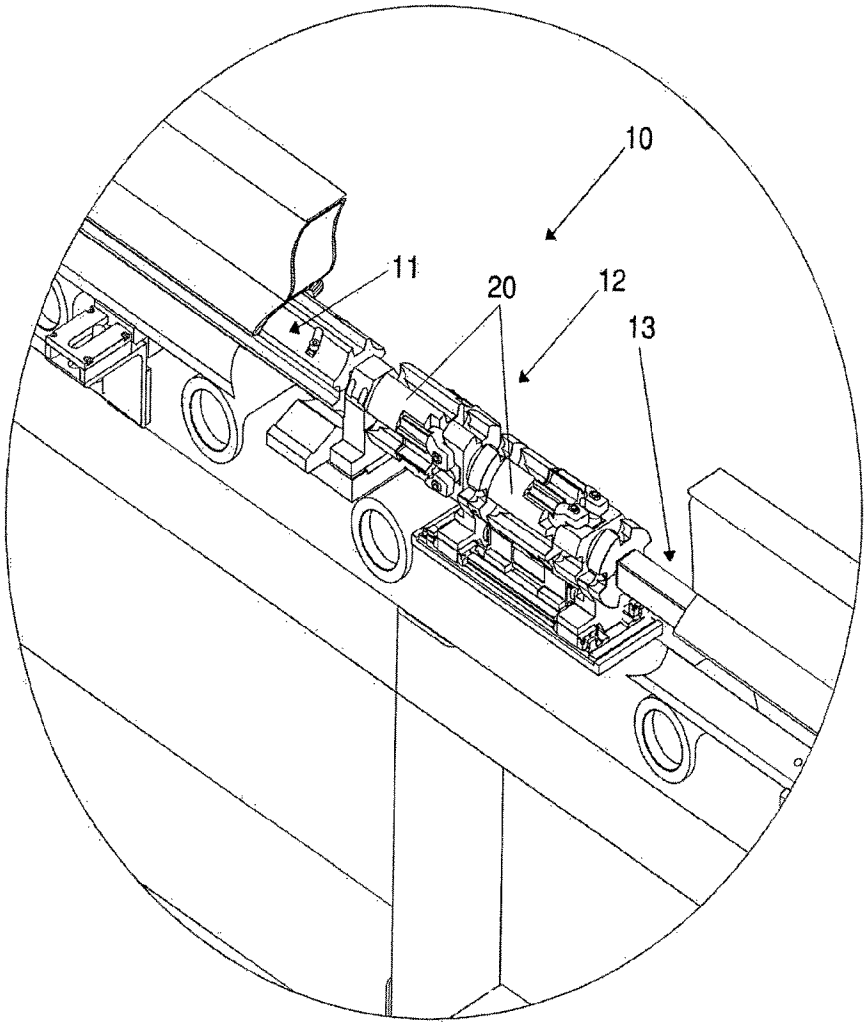
FIG. 1*a* shows an enlargement of part of the view in FIG. 1.
Figure 2A:
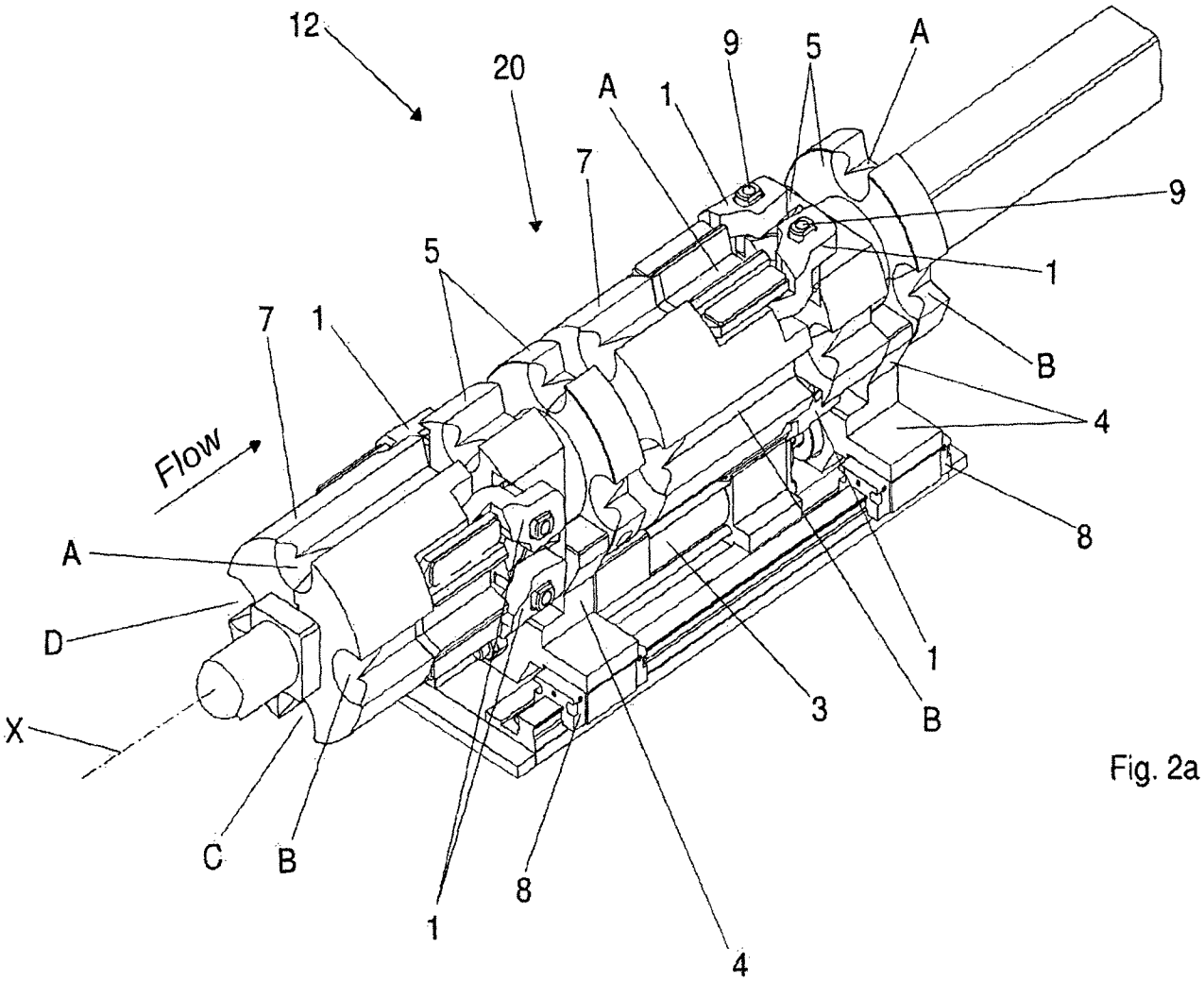
FIG. 2*a* shows a first perspective view of a braking system of the apparatus in FIG. 1.
Figure 2B:
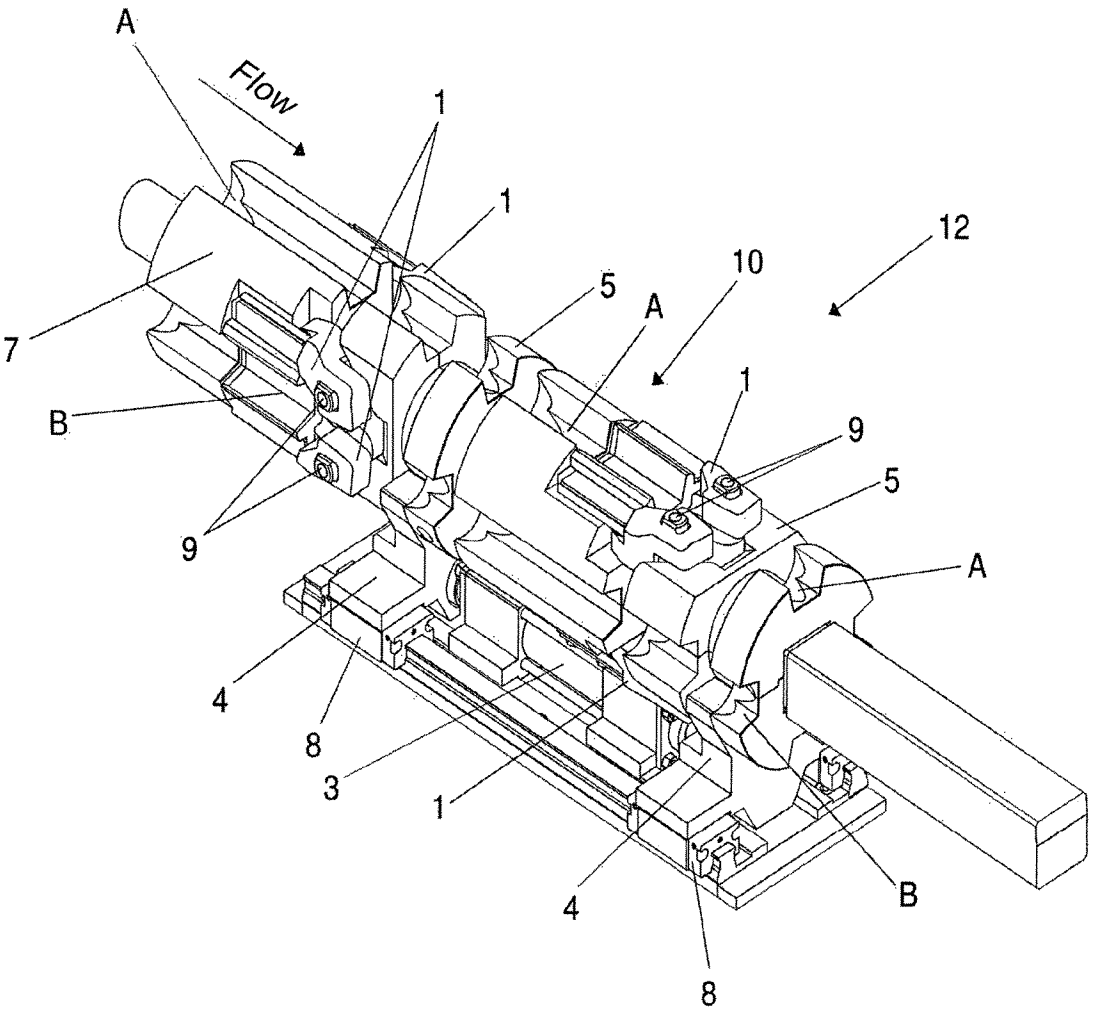
FIG. 2*b* shows a second perspective view of the braking system in FIG. 1.
Figure 3:
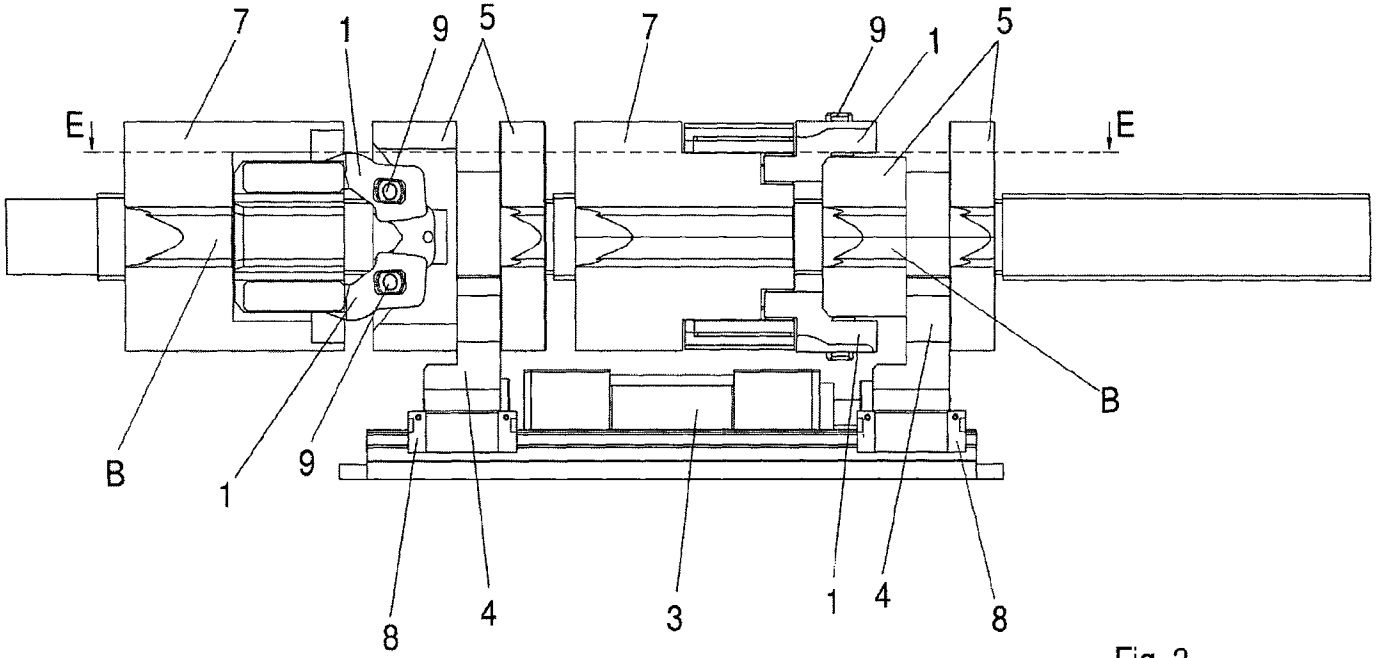
FIG. 3 shows a side view of the braking system in FIG. 1.
Figure 4:
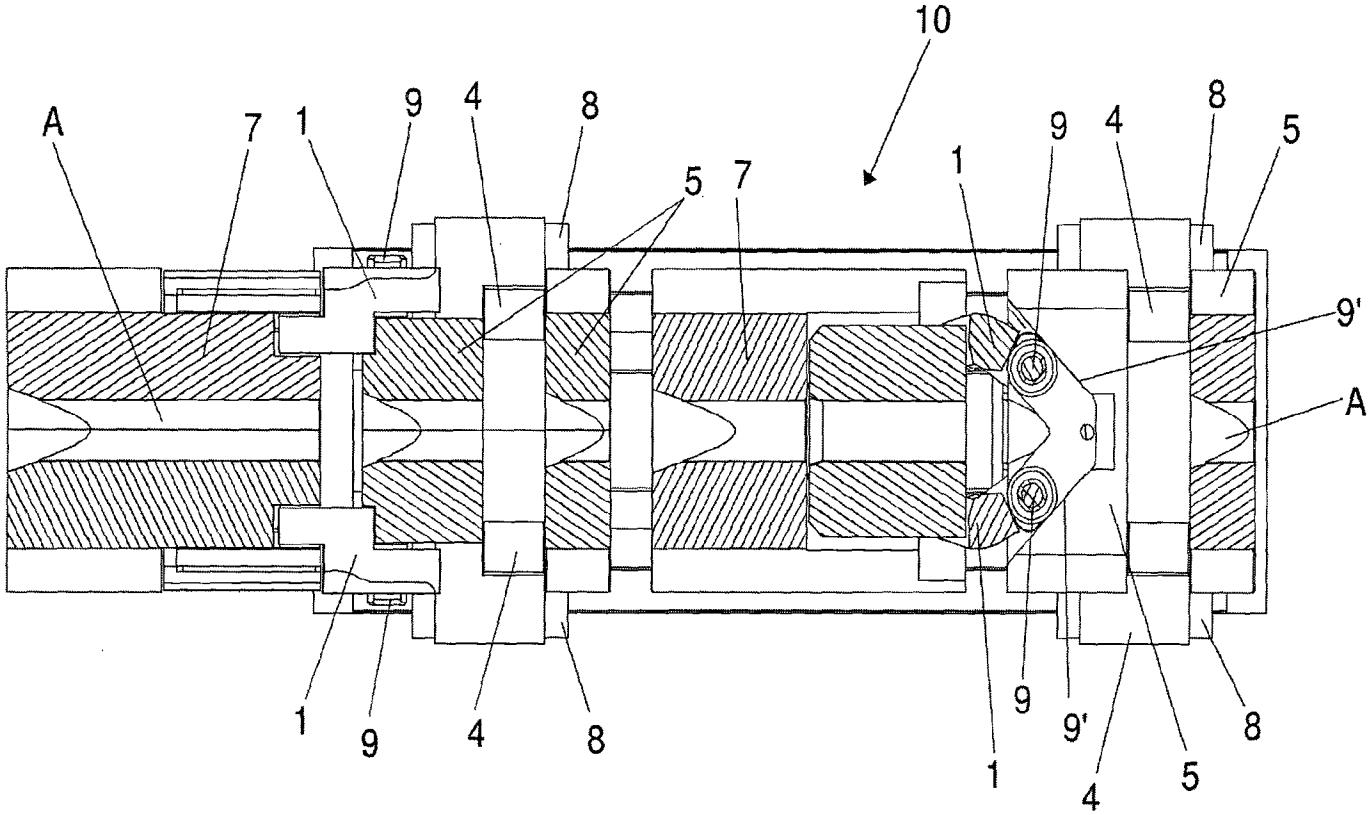
FIG. 4 shows a section view of the braking system in FIG. 3 taken along the plane E-E.
Figure 5:
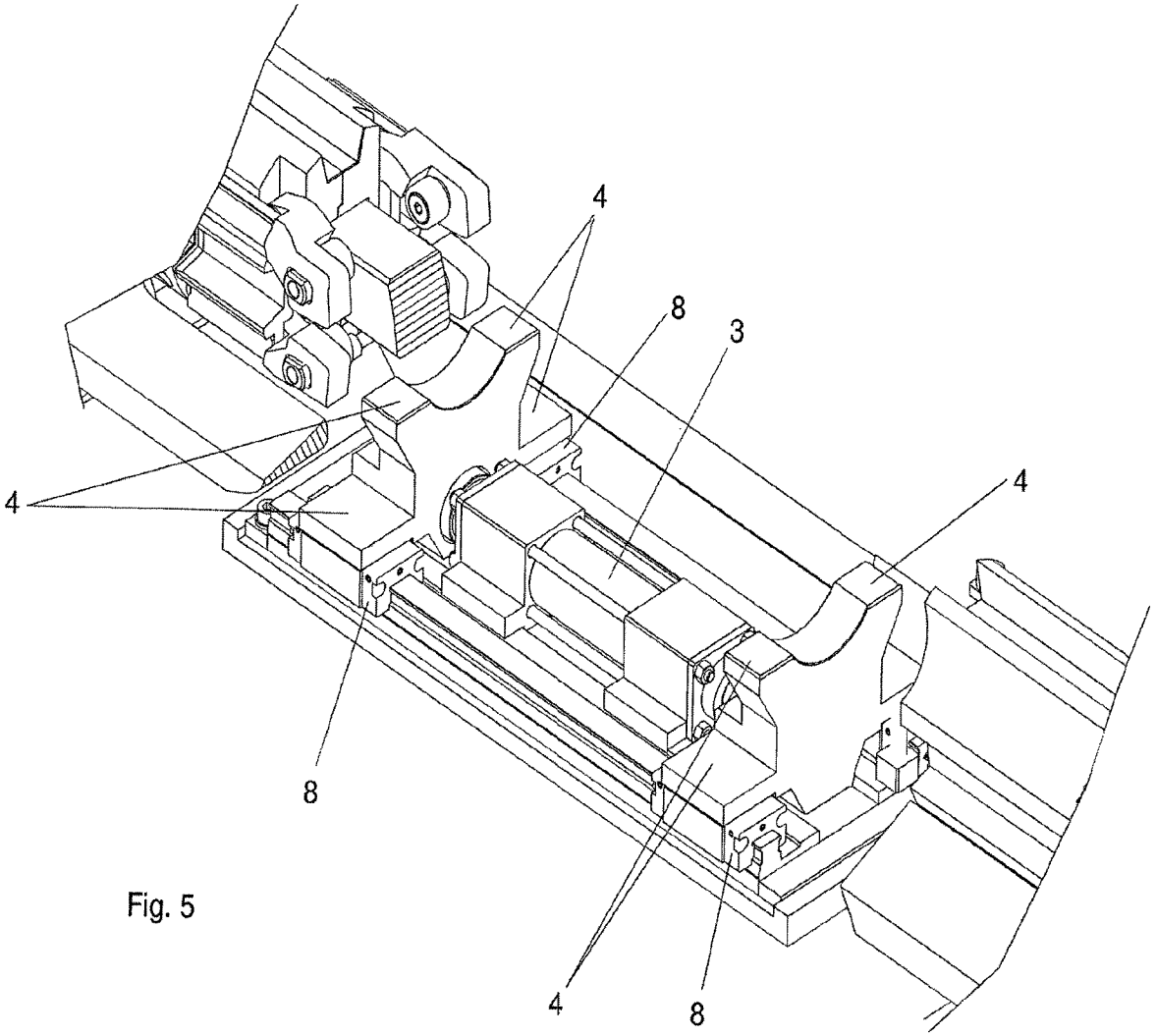
FIG. 5 shows a perspective view of further components of the braking system in FIG. 3.

For example, as shown in FIGS. 1 and 1*a*, the stretch 12 of rotor 10, in which the braking device 20 is integrated, is arranged between an end stretch 11 and at least one second end stretch 13 of rotor 10. Stretch 12 comprises fixed portions 7 and corresponding movable portions 5 (FIGS. 2*a*, 2*b*, 3, 4). Said movable portions 5 can move with respect to the fixed portions 7, being adapted to translate along the longitudinal axis X.

In the example in the figures, there are four longitudinal channels 10, reciprocally spaced apart by the same angular amplitude, but they can be either fewer or more than four.

In this exemplificative embodiment, stretch 12 comprises two fixed portions 7 and two movable portions 5, arranged in a reciprocally alternating manner along axis X. Portions of the four longitudinal channels A, B, C and D, aligned with the corresponding channel portions present in the other longitudinal stretches 11, 13 of rotor 10 are obtained on these fixed portions 7 and movable portions 5.

The braking device 20 is provided with a pair of braking elements 1 in each of the longitudinal channels A, B, C, D. The braking elements 1 of each pair, arranged symmetrically, are configured to pass from an opening position, in which they leave the passage of a bar free in the respective channel, to a closing position on the bar to brake the bar itself.

The braking elements 1 of each pair are hinged to a fixed portion 7 and provided with tappet elements or rollers 9 which constrain said braking elements 1 to a corresponding movable portion 5. The tappet elements 9 are integrally fixed to the respective braking elements 1 and, in a preferred variant, can run inside movable sliding guides 9' made on the movable portions 5. Such movable sliding guides 9' define, for example, a V shape (FIG. 4) and each tappet element 9 can move within one of the two V-shaped arms.

With reference to the figures, for example, the pair of braking elements 1 of channel A is fixed to a first fixed portion 7 and is constrained, in a non fixed manner, to a first movable portion 5 by means of the respective tappet elements 9. The pair of braking elements 1 of channel C, diametrically opposite to channel A, is fixed on the same first fixed portion 7 and is constrained, in a non fixed manner, to the same first movable portion 5 by means of the respective tappet elements 9. The two pairs of braking elements 1 of channel A and of channel C are diametrically opposite and symmetrically arranged with respect to a first plane containing axis X. In the position in FIGS. 2*a*-3, said first plane is a horizontal plane.

Instead, the pair of braking elements 1 of channel B is fixed to a second fixed portion 7 and is constrained, in a non fixed manner, to a second movable portion 5 by means of the respective tappet elements 9. The pair of braking elements 1 of channel D, diametrically opposite to channel B, is fixed on the same second fixed portion 7 and is constrained, in a non fixed manner, to the same second movable portion 5 by means of the respective tappet elements 9. The two pairs of braking elements 1 of channel B and of channel D are diametrically opposite and symmetrically arranged with respect to a second plane containing axis X, perpendicular to said first plane. In the position in FIGS. 2*a*-3, said second plane is a vertical plane.

Each pair of braking elements 1 is actuated by means of appropriate actuating means. Such actuating means comprise at least one fixed cylinder 3, e.g. of the pneumatic or hydraulic type, adapted to slide the support elements 4 of the movable portions 5 of the stretch in a direction parallel to axis X. In particular, the supporting elements 4 move over a predetermined travel along axis X on respective, for example prism-shaped, fixed shoes 8. Shoes 8 are completely fixed while the supporting elements 4 may perform only a forward-backward longitudinal movement on said shoes 8.

Said supporting elements 4 are, for example, of the fork type and can include a supporting surface, for example in the form of a semi-cylindrical side surface, adapted to support a part of the corresponding movable portion 5 of complementary shape.

Said movable portions 5 are thus constrained only axially to the supporting elements so that when said supporting elements 4 move by a predetermined travel, the movable sliding guides 9' of the movable portions 5 cause a symmetric closing or opening movement of the tappet elements 9 and thus of the braking elements 1. In essence, these movable portions 5 are cams which are rotationally integral with the rotor so as to rotate therewith.

In a first variant, shown in the figures, the actuating cans comprise only one fixed, double-rod or through-rod cylinder 3, adapted to slide two supporting elements 4 of respective movable portions 5 to actuate all the braking element pairs 1 of the braking device 20 simultaneously.

In a second variant (not shown in the figures), the actuating means comprise two fixed cylinders: a first fixed cylinder to actuate the pairs of braking elements of two longitudinal channels of the rotor simultaneously, and a second fixed cylinder to actuate the pairs of braking elements of the other two longitudinal channels simultaneously.

In a third variant (not shown in the figures), the actuating means comprise four fixed cylinders, each fixed cylinder actuating the pair of rotating elements of a respective longitudinal channel of the rotor.

The method of braking bars, carried out by means of a bar unloading apparatus according to the invention is described below. Such a braking method comprises the following steps:

providing the braking elements 1 in an opening position in at least one first longitudinal channel, for example channel A (FIG. 2*a*), arranged in alignment with the bar feeding axis towards rotor 10, to leave the space inside the channel five and allow a bar to pass;

inserting a longitudinal bar from a high-speed upstream plant into the first channel A;

once the tail of said longitudinal bar is inside channel A, rotating the longitudinal rotor 10 by a predetermined angular amplitude, for example 45°, about the longitudinal axis X, while simultaneously braking the longitudinal bar by switching the braking elements 1 from said opening position to a closing position on said longitudinal bar, by virtue of the fixed cylinder 3 which moves the supporting elements 4 and thus the movable portions 5.

The longitudinal movement of the movable portions 5 causes a rotation of the braking elements 1 hinged onto the corresponding fixed portions 7. This symmetric rotation causes the two braking elements 1 to approach each other and the bar therebetween to be braked.

Once the bar has been braked and released from the braking elements 1, it is unloaded laterally with respect to the bar unloading apparatus onto a specific roller bed.

These braking elements 1 are advantageously made of thermoplastic materials, synthetic or natural rubbers.

The invention claimed is:

1. A bar unloading apparatus of the revolver type, comprising:

a longitudinal rotor divided into at least three longitudinal stretches integral with one another and adapted to rotate about longitudinal rotation axis, on the outer longitudinal surfaces of which there is provided a plurality of longitudinal channels, extending on the at least three longitudinal stretches over the whole longitudinal extension of the rotor and parallel to said longitudinal rotation axis, to receive respective longitudinal bars, and at least one braking device for braking the longitudinal bars entering in at least one of the longitudinal channels, wherein the at least one braking device is integrated in at least one first stretch of said at least three longitudinal stretches is rotationally fixed to the longitudinal rotor and is provided with braking elements in each of said longitudinal channels so that said at least one braking device can rotate together with the longitudinal rotor and brake the longitudinal bars even during a rotation of the longitudinal rotor.

2. A bar unloading apparatus according to claim 1, wherein said at least one braking device comprises a pair of braking elements for each longitudinal channel, adapted to approach to each other to brake a respective longitudinal bar.

3. A bar unloading apparatus according to claim 2, wherein there are provided actuating, means for actuating each pair of braking elements.

4. A bar unloading apparatus according to claim 3, wherein the first stretch of said at least three longitudinal stretches comprises fixed portions and movable portions, the latter being adapted to shift along said longitudinal rotation axis.

5. A bar unloading apparatus according to claim 4, wherein the braking elements of each pair are hinged to a fixed portion and provided with tappet elements which restrain said braking elements to a corresponding movable portion.

6. A bar unloading apparatus according to claim 5, wherein said actuating means comprise at least one fixed cylinder adapted to slide support elements of the movable portions parallel to said longitudinal rotation axis, said movable portions being only axially restrained to said support elements so that the tappet elements cause a symmetric closing or opening movement of the braking elements.

7. A bar unloading apparatus according to claim 6, wherein said movable portions are provided with movable sliding guides for the tappet elements.

8. A bar unloading apparatus according to claim 7, wherein said movable sliding guides define a V-shape.

9. A bar unloading apparatus according to claim 6, wherein said actuating means comprise a single fixed cylinder of the double rod or through rod type, adapted to slide two supporting elements of respective second movable portions in order to actuate all the pairs of braking elements.

10. A bar unloading apparatus according to claim 6, wherein said actuating means comprise two fixed cylinders: a first fixed cylinder to actuate the pairs of braking elements of a first half of longitudinal channels of the longitudinal rotor at the same time, and a second fixed cylinder to actuate the pairs of braking elements of the second half of the longitudinal channels at the same time.

11. A bar unloading apparatus according to claim 6, wherein there are provided four longitudinal channels and said actuating means comprise four fixed cylinders, each fixed cylinder actuating the pair of braking elements of a respective longitudinal channel of the longitudinal rotor.

12. A bar braking method, carried out by means of a bar unloading apparatus according to claim 1, comprising the following steps:

providing the braking elements in an opening position in at least one first channel of said longitudinal channels to leave a space inside the least one first channel free;

inserting a longitudinal bar into said first channel, once a tail of said longitudinal bar is inside said first channel, rotating the longitudinal rotor by a predetermined angular amplitude about the longitudinal rotation axis, simultaneously braking the longitudinal bar by switching the braking elements from said opening position to a closing position on said longitudinal bar.

* * * * *